US005195337A

United States Patent [19]

Gutschmit

[11] Patent Number: 5,195,337

[45] Date of Patent: Mar. 23, 1993

[54] APPARATUS AND METHOD FOR FLUSHING DEBRIS FROM THE CYLINDER SLOTS OF CIRCULAR KNITTING MACHINES

[75] Inventor: Alan Gutschmit, Troy, N.C.

[73] Assignee: Alandale Industries, Inc., Troy, N.C.

[21] Appl. No.: 792,349

[22] Filed: Nov. 14, 1991

[51] Int. Cl.[5] ..... D04B 35/32

[52] U.S. Cl. ..... 66/168; 66/8; 15/302

[58] Field of Search ..... 66/8, 168; 15/302

[56] References Cited

U.S. PATENT DOCUMENTS

| | | | |
|---|---|---|---|
| 3,269,151 | 8/1966 | Abrams et al. | 66/168 |
| 3,481,431 | 12/1969 | Dorsey | 66/8 |
| 3,545,233 | 12/1970 | Lombardi | 66/168 |
| 3,956,790 | 5/1976 | Ishiwata et al. | 15/302 |
| 4,703,632 | 11/1987 | Izumi et al. | 66/168 |
| 4,741,181 | 5/1988 | Plath | 66/104 |
| 4,869,080 | 9/1989 | Rovinsky et al. | 66/168 |

FOREIGN PATENT DOCUMENTS

| | | | |
|---|---|---|---|
| 2031088 | 6/1969 | Fed. Rep. of Germany | 66/8 |
| 0226921 | 5/1983 | German Democratic Rep. | 66/8 |
| 672623 | 10/1964 | Italy | 66/8 |
| 1296643 | 3/1987 | U.S.S.R. | 66/8 |
| 1305406 | 4/1987 | U.S.S.R. | 66/8 |
| 1326674 | 4/1987 | U.S.S.R. | 66/168 |
| 1160660 | 8/1969 | United Kingdom | 66/168 |
| 2018304 | 10/1979 | United Kingdom | 66/168 |

*Primary Examiner*—Andrew M. Falik
*Assistant Examiner*—John J. Calvert
*Attorney, Agent, or Firm*—Shefte, Pinckney & Sawyer

[57] ABSTRACT

An apparatus and method for flushing lint and other debris from the cylinder needle and sinker rest ring slots of a circular knitting machine utilizes a pair of nozzles disposed closely adjacent the upper end of the cylinder to inject into the slots from one nozzle a narrow pressurized stream of flushing oil and from the other nozzle a similar stream of pressurized air, either on an alternating or simultaneous basis, periodically over the course of operation of the knitting machine, preferably once every twenty-four hours, i.e. three work shifts, of machine operation.

41 Claims, 6 Drawing Sheets

APPARATUS AND METHOD FOR FLUSHING DEBRIS FROM THE CYLINDER SLOTS OF CIRCULAR KNITTING MACHINES

BACKGROUND OF THE INVENTION

The present invention relates generally to circular knitting machines and, more particularly, to apparatus and methods for removing debris which accumulates during the course of machine operation in the cylinder slots of such machines, especially the needle and sinker rest ring slots of so-called sinker-top or single-needle circular knitting machines.

At substantially all stages of the processing of textile fibers, particularly cotton, from the initial fiber cleaning and preparation stage through yarn spinning and fabric production, the necessary handling of the textile fibers and yarns formed therefrom inherently liberates minute pieces of fiber, commonly referred to as lint, as well as other particulate dust and debris which tend to become readily airborne within the work area of the textile processing plant and ultimately to settle and accumulate on machinery and other exposed surfaces within the plant interior.

In fabric production operations, airborne lint and dust which settles on the processing machinery may adversely affect the proper operation of machinery components and may even cause machine stoppages as well as defects in the fabric being produced.

A variety of approaches have been taken in the past to control the accumulation of lint and other debris on textile machinery. For example, various equipment has been proposed and is available to continuously filter ambient debris-laden air within the working environment in a textile plant. Also, fans and other blower equipment may be mounted within the textile workplace, sometimes directly attached to the textile machinery itself, to generate moving forced air currents over machinery surfaces which are prone to debris accumulation and within other strategic areas of textile plants to minimize debris accumulation on machinery surfaces. Additionally, it is commonplace to provide machine operators with hand-held nozzles supplied with compressed air to perform selective cleaning of machine components on a periodic basis.

While generally effective on an overall basis, equipment and techniques of the type described may have little affect on debris accumulation on machine components which are difficult to reach or cannot be reached by such equipment. For example, textile circular knitting machines characteristically have a rotatable cylinder circumferentially formed with a plurality of axial slots each of which carries a reciprocating knitting needle. In many circular knitting machines commonly called sinker-top or single needle machines, an annular dial is fixed to the cylinder concentrically about its upper end for integral rotation therewith and is formed with a plurality of radial slots offset from the cylinder needle slots for carrying sinkers which reciprocate radially between the cylinder needles. A radially-slotted sinker rest ring is affixed to the upper end of the cylinder with its slots aligned with the dial slots to support the sinkers when projected from the dial radially between the cylinder needles. To a large extent, the cylinder needle slots are covered by cam plates and other machinery components so that the slots are not easily accessible for cleaning. Nevertheless, because the slots open upwardly for needle reciprocation in the normal course of machine operation, the slots are subject to accumulation of lint and debris released from the yarns being knitted as well as airborne lint and debris. Likewise, the knitted fabric produced by the interaction of the reciprocating needles and sinkers is withdrawn inwardly of the cylinder directly over the sinker rest ring, making its slots subject to accumulation of released lint and debris while at the same time covering the slots from ready access for cleaning. Such accumulations are of particular concern since they may impair the proper reciprocation and knitting action of the needles and sinkers.

One common technique to address this problem has been to periodically take circular knitting machines out of service, e.g., every few weeks of operation, for careful cleaning of the needle and sinker rest ring slots of the cylinder. Another approach has been for a machine operator to manually pour lubricating oil into the slots at the upper end of the cylinder upon each doffing of fabric from the machine to attempt to wash accumulated debris from the slots. However, this oiling technique is difficult to regulate and, moreover, because the knitted fabric covers the sinker rest ring slots, these slots generally are not penetrated well with oil and at the same time a significant portion of the fabric becomes soiled with oil and must be discarded. Some conventional machines are equipped with an oiling device which can be selectively operated by the machine operator to dispense a flow of oil into the cylinder slots to perform essentially the same washing operation. This oiling technique also is largely ineffective to loosen and remove any significant amount of accumulated debris and typically soils a significant amount of fabric with the lubricating oil. Since conventional wisdom is that this form of oiling operation should be performed upon each doffing of the knitting machine, substantial fabric losses are thereby suffered, and the efficiency of the machine's operation is correspondingly reduced.

SUMMARY OF THE INVENTION

It is accordingly a fundamental object of the present invention to provide an improved apparatus and method for fluidized flushing of the cylinder slots of a circular knitting machine which overcomes the foregoing disadvantages of conventional devices and methods as discussed above. Another object of the present invention is to provide such a flushing apparatus and method which will minimize knitting machine downtime and improve the operating efficiency of a knitting machine. In this regard, it is a further object of the present invention to provide a knitting machine flushing apparatus and method which is sufficiently effective in removing accumulated debris that actuation of the flushing apparatus and performance of the flushing method can be performed much less often than is conventionally considered necessary or desirable. A further object of the present invention is to provide a knitting machine flushing apparatus and method which produces minimal soiling of the fabric being knitted. Other objects of the invention will be apparent from the following disclosure.

Basically, the apparatus and method of the present invention are adapted for use in connection with virtually any circular knitting machine of the type having a rotatable cylinder formed with a plurality of slots carrying reciprocating knitting elements. In particular, this invention is especially adaptable to those knitting machines of the so-called sinker-top or single-needle type wherein a plurality of knitting needles reciprocate in axial slots of the cylinder and a radially-slotted dial and a radially-slotted sinker rest ring are rotatable integrally with the needle cylinder for carrying a plurality of sinker elements reciprocable radially relative to the cylinder needles. As used herein, the term "cylinder slots" is intended to encompass either or both the axial needle slots in the cylinder itself and the radial slots in the sinker rest ring portion of the cylinder.

Briefly summarized, the flushing apparatus and method of the present invention utilizes a source of a pressurized flushing fluid, preferably at least predominantly an oil, and a source of a pressurized gas, preferably at least predominantly air. A flushing nozzle and a cleaning nozzle are each fixedly mounted adjacent the cylinder, suitable means being provided for selectively communicating the flushing nozzle with the fluid source to supply pressurized fluid to the flushing nozzle and, similarly, suitable means being provided for selectively communicating the cleaning nozzle with the gas source to supply pressurized gas to the cleaning nozzle. Each nozzle has an emission opening oriented relative to the cylinder to discharge the fluid or gas, as the case may be, directly into the cylinder slots as the cylinder rotates. The flushing and cleaning nozzles are operated, either in alternation or simultaneously, to discharge the pressurized flushing fluid and the pressurized gas to forcibly flush and expel accumulated debris from the cylinder slots. It is contemplated that optimal results can be achieved by actuating the flushing and cleaning nozzles at periodic intervals of at least a predetermined number of doffs of knitted fabric from the knitting machine and, more preferably, about once every twenty-four hours of operation of the knitting machine, i.e., once every three eight-hour working shifts.

In the preferred embodiment of the present flushing apparatus and method, each of the flushing nozzle communicating means and the cleaning nozzle communicating means utilize a respective valve arrangement to permit selective alternate or simultaneous operation of the flushing and cleaning nozzles. Preferably, the flushing and cleaning nozzles are arranged with their respective emission openings disposed alongside one another closely adjacent the cylinder in substantially identical orientation with respect thereto, preferably adjacent the upper end of the cylinder directed generally at the interface between the needle and sinker rest ring slots at a downward angle thereto.

The flushing nozzle in the preferred embodiment is configured to discharge the pressurized fluid in the form of a relatively narrow and substantially continuous stream. For this purpose, the emission opening of the fluid nozzle may be defined by a single circular orifice, preferably of a diameter in the range of approximately 0.030 inches.

To best optimize cleaning of the cylinder slots, it is further preferred that the fluid source be adapted to generate sufficient pressure in the flushing fluid to cause it to be discharged from the flushing nozzle at a sufficient velocity to forcibly remove debris from the slots. More particularly, the fluid velocity is related to the rotational operating speed of the cylinder to accomplish penetration of the fluid to a predetermined extent in the slots. It is presently contemplated that a fluid velocity of at least about 700 inches per minute will achieve satisfactory results, but more preferably the fluid velocity should be in the range of about 1,000 inches per minute for most large diameter multi-station circular knitting machines.

The pressurized fluid source is preferred to also include a suitable arrangement to deliver a predetermined quantity of the pressurized fluid to the flushing nozzle upon each actuation of the flushing nozzle. For example, in the preferred flushing apparatus, the pressurized fluid source utilizes a piston-and-cylinder assembly defining a fluid chamber of a predetermined fluid volume at one side of the piston in communication with the flushing nozzle. A reservoir of the flushing fluid is communicated with the chamber to supply the fluid thereto and a suitable means is provided to actuate movement of the piston for expelling the fluid from the chamber upon actuation of the flushing nozzle. As necessary or desirable, the piston-and-cylinder assembly may be constructed to permit the volume of the fluid in the chamber to be selectively adjusted, e.g., by a suitable mechanism for selectively varying the piston stroke.

It is additionally preferred that a second cleaning nozzle be fixedly mounted adjacent the cylinder and be communicated with the pressurized gas source through the cleaning nozzle communicating means to discharge the gas through an emission opening in the nozzle radially into the axial cylinder slots simultaneously with operation of the first-mentioned cleaning nozzle. A third nozzle is mounted ad]acent the dial and is independently communicated with the pressurized gas source to discharge the gas directly onto the sinker elements continuously throughout operation of the knitting machine. Preferably, this third cleaning nozzle is oriented with its emission opening directed predominantly axially relative to the cylinder to discharge the pressurized gas onto the sinker elements when they are projected from the dial in knitting manipulation relative to the cylinder needles.

A timer or other suitable device may also be employed in the present flushing apparatus and method to generate a signal periodically during operation of the knitting machine to indicate to a machine operator the appropriate intervals for performance of a flushing operation.

DESCRIPTION OF THE PREFERRED EMBODIMENT

Figure 1:
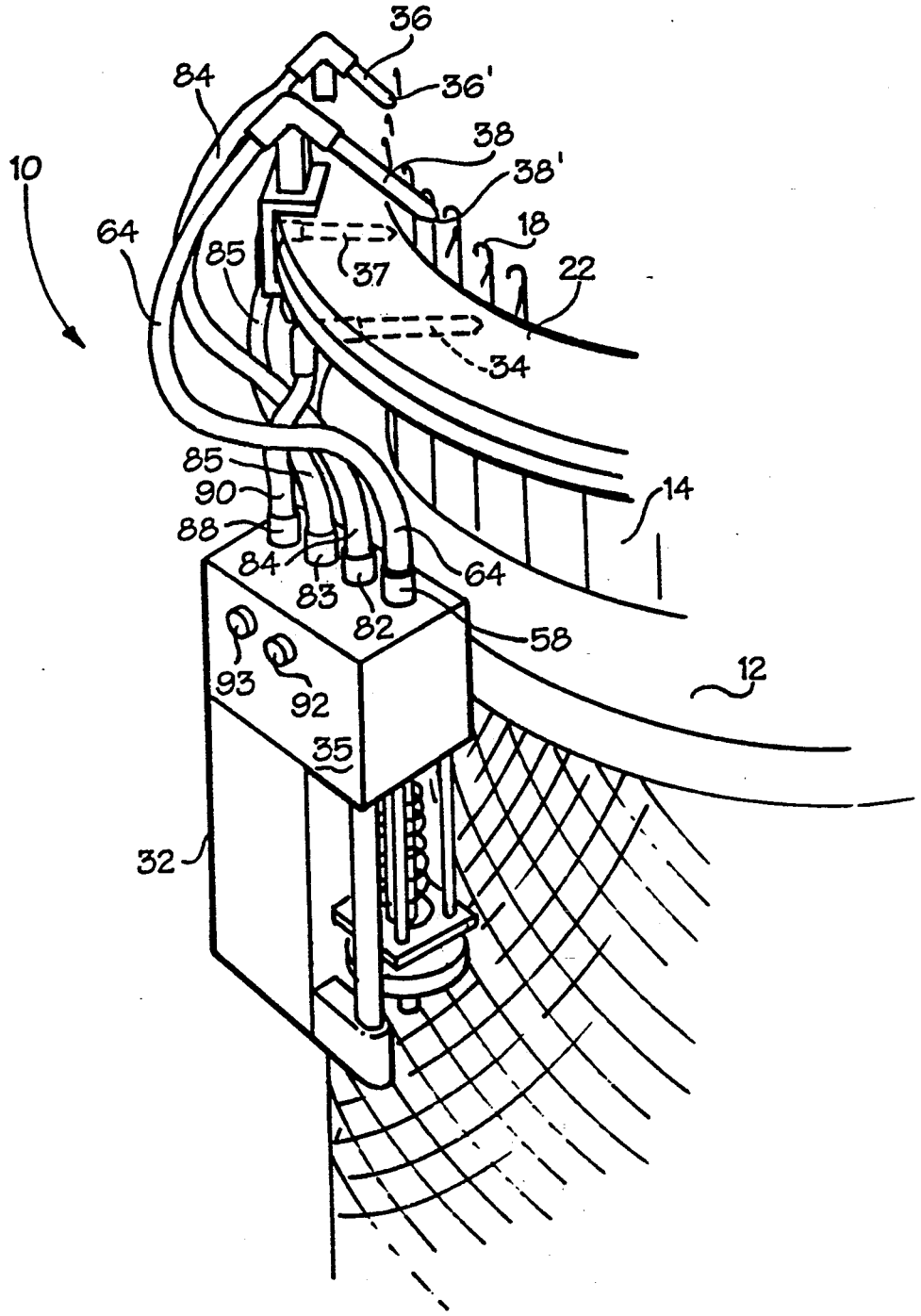
FIG. 1 is a perspective view, partially broken away, of a conventional large-diameter sinker-top circular knitting machine having installed thereon a flushing apparatus according to the preferred embodiment of the present invention.

Referring now to the accompanying drawings and initially to FIG. 1, a flushing apparatus according to the preferred embodiment of the present invention is shown generally at 10 as preferably installed on a conventional large-diameter multi-station circular knitting machine of the so-called sinker top or single needle type, indicated generally at 12. As aforementioned, the flushing apparatus 10 is intended to be adaptable for use in connection with virtually any conventional circular knitting machine and, accordingly, it is to understood that the illustrated knitting machine 12 is shown merely as a representative example.

Figure 2:
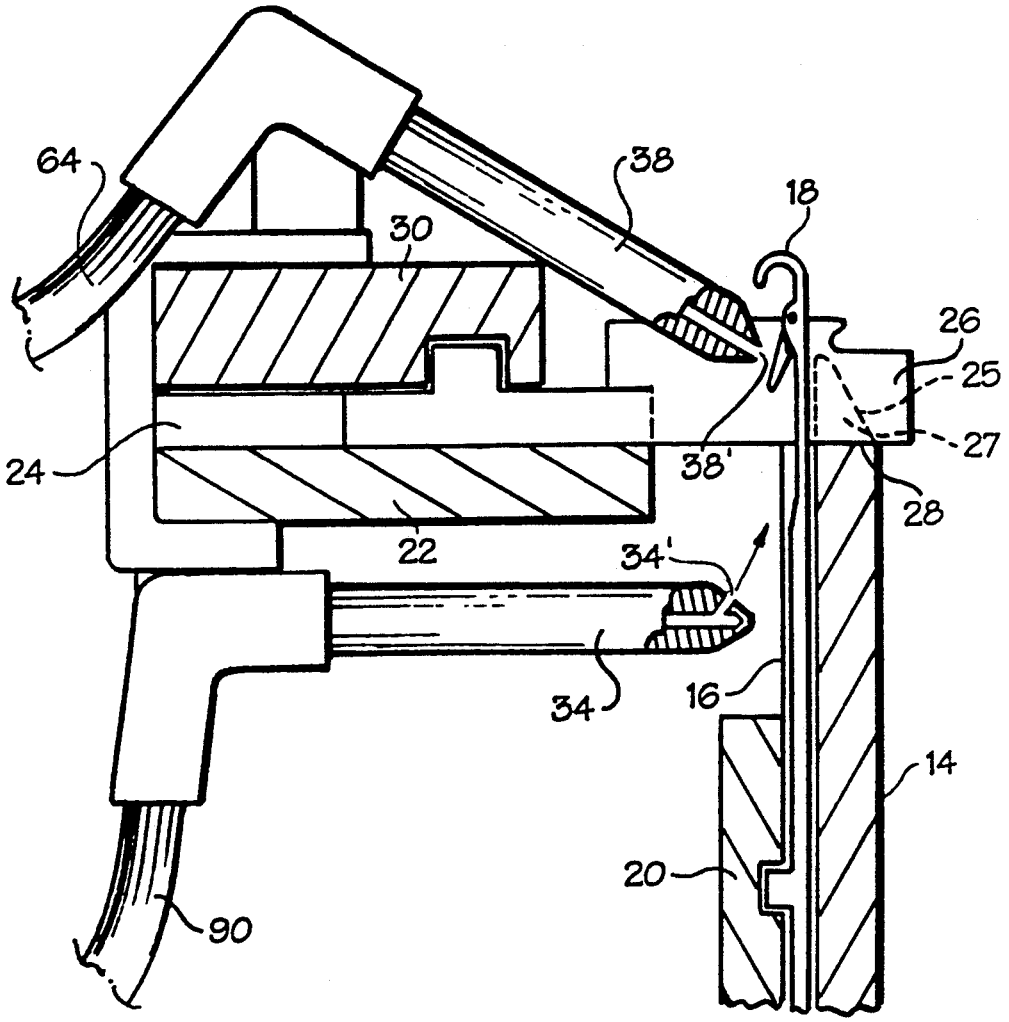
FIG. 2 is a vertical cross-sectional view through the cylinder and dial of the knitting machine of FIG. 1, showing the mounting of the flushing nozzle and the continuously operating cleaning nozzle.
Figure 3:
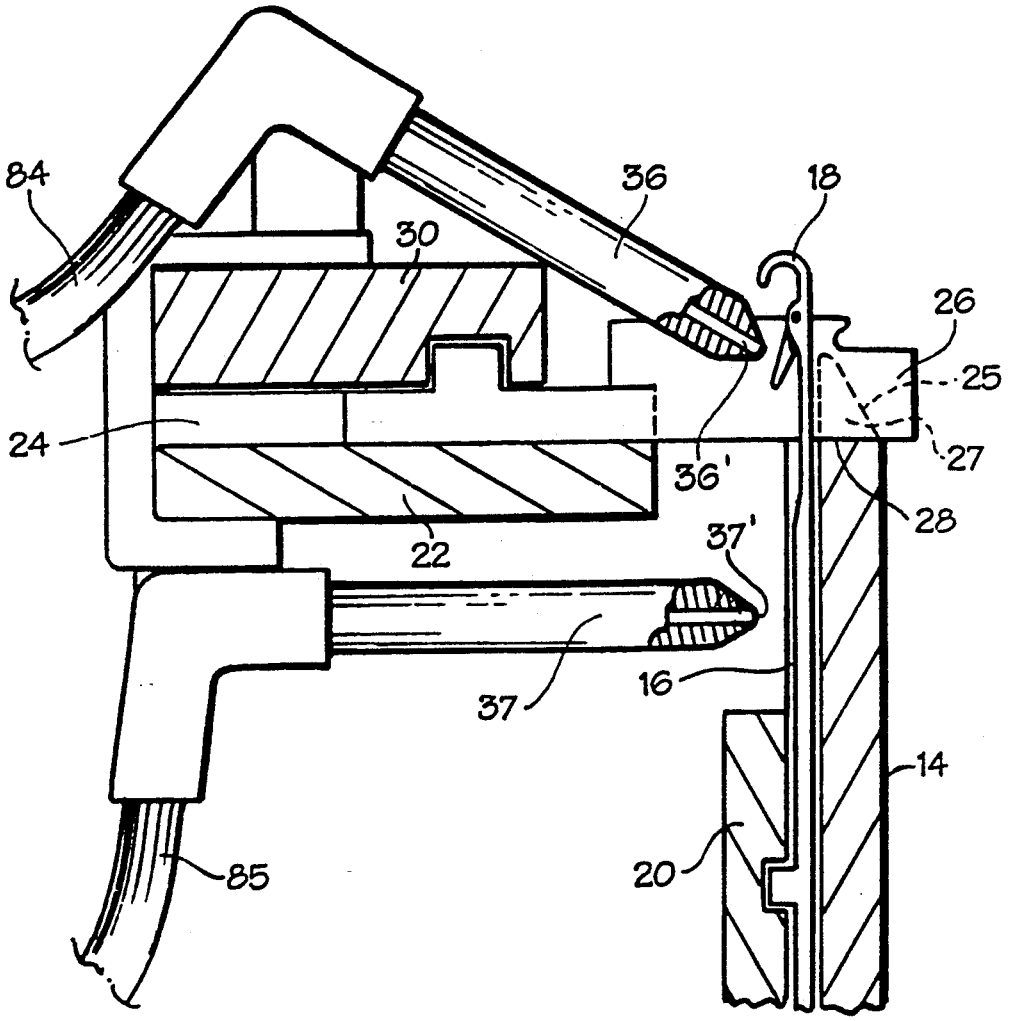
FIG. 3 is a vertical cross-sectional view through the cylinder and dial of the knittinq machine of FIG. 1, similar to but circumferentially spaced from the view of FIG. 2, showing the mounting of the other two intermittently operated cleaning nozzles.

The knitting machine 12 is basically equipped with a rotatably driven, axially upright needle cylinder 14 formed in its outer circumferential periphery with a plurality of axially extending slots 16 each of which carries at the upper end of the cylinder 14 a knitting needle 18, or other suitable knitting instrument or element, for axial knittinq reciprocation under the control of a stationary cam arrangement 20 mounted on the machine frame outwardly about the rotating cylinder, all as best seen in FIGS. 2 and 3. A circular dial 22 is affixed outwardly about and concentric to the upper end of the cylinder 14 for integral rotation therewith, the dial 22 being formed with a plurality of annularly spaced radial slots 24 each of which carries at its radially inward end a sinker 26, or other similar knitting instrument or element, for radial knitting reciprocation of the sinkers 26 inwardly and outwardly between the knitting needles 18 under the control of a sinker cam arrangement 30 stationarily mounted to the machine frame directly above the dial 22. As seen in FIGS. 2 and 3, a sinker rest ring 25 is affixed to the upper end of the cylinder 14 and is formed with a plurality of annularly spaced radial slots 27 aligned with the dial sinker slots 24 to provide resting surfaces 28 for the sinkers 26 when projected outwardly from their respective dial slots 24 and between the needles 18.

The flushing apparatus 10 basically includes a flushing control unit 32 stationarily mounted on the frame of the knitting machine 12 to control the supply of a pressurized flushing oil or another suitable fluid and pressurized air or another gas to a series of four nozzles 34,36,37,38 mounted on the machine frame directly adjacent the interface between the cylinder 14 and the dial 22.

Figure 4:
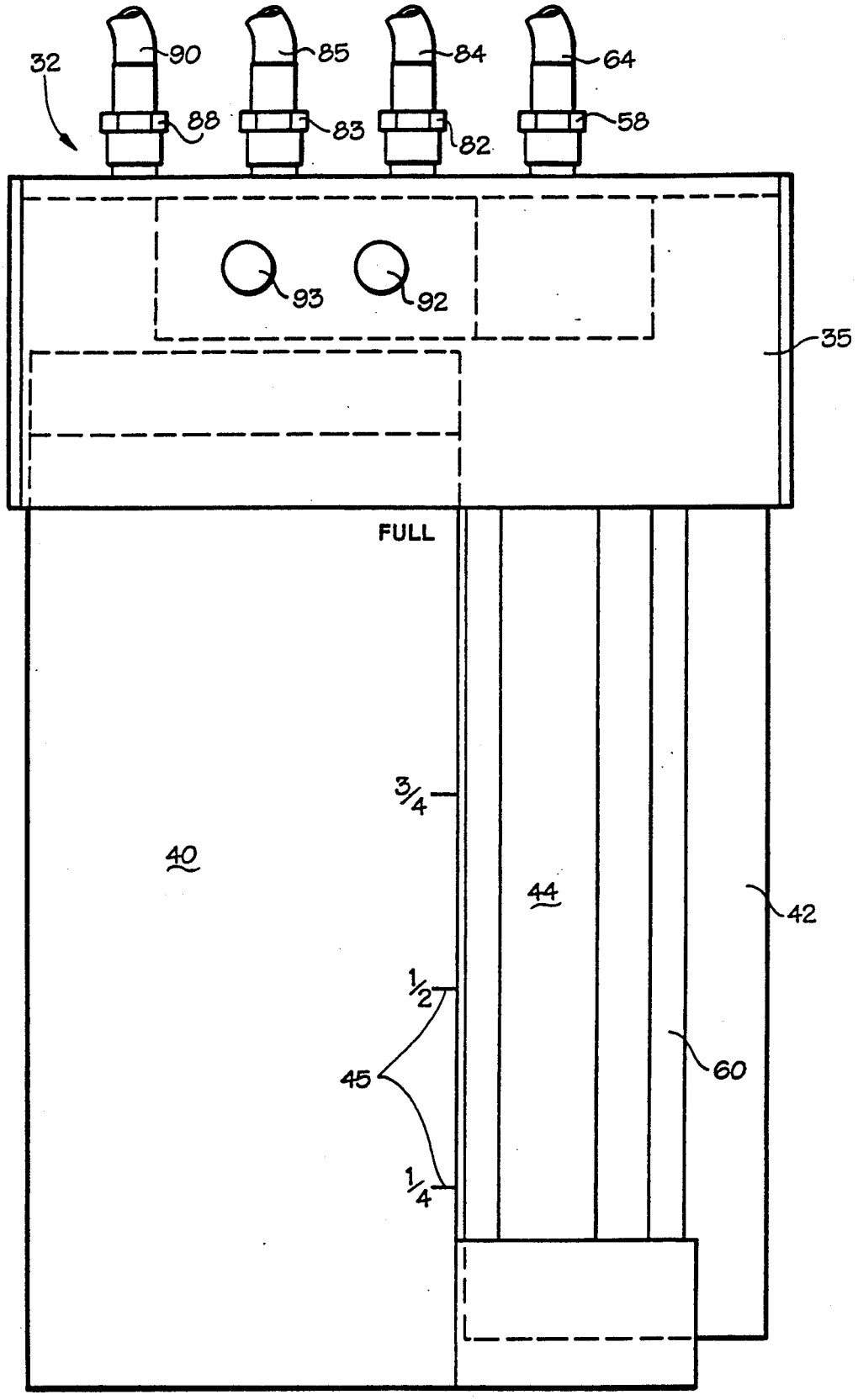
FIG. 4 is a side elevational view of the flushing unit of the flushing apparatus of FIG. 1.
Figure 5:
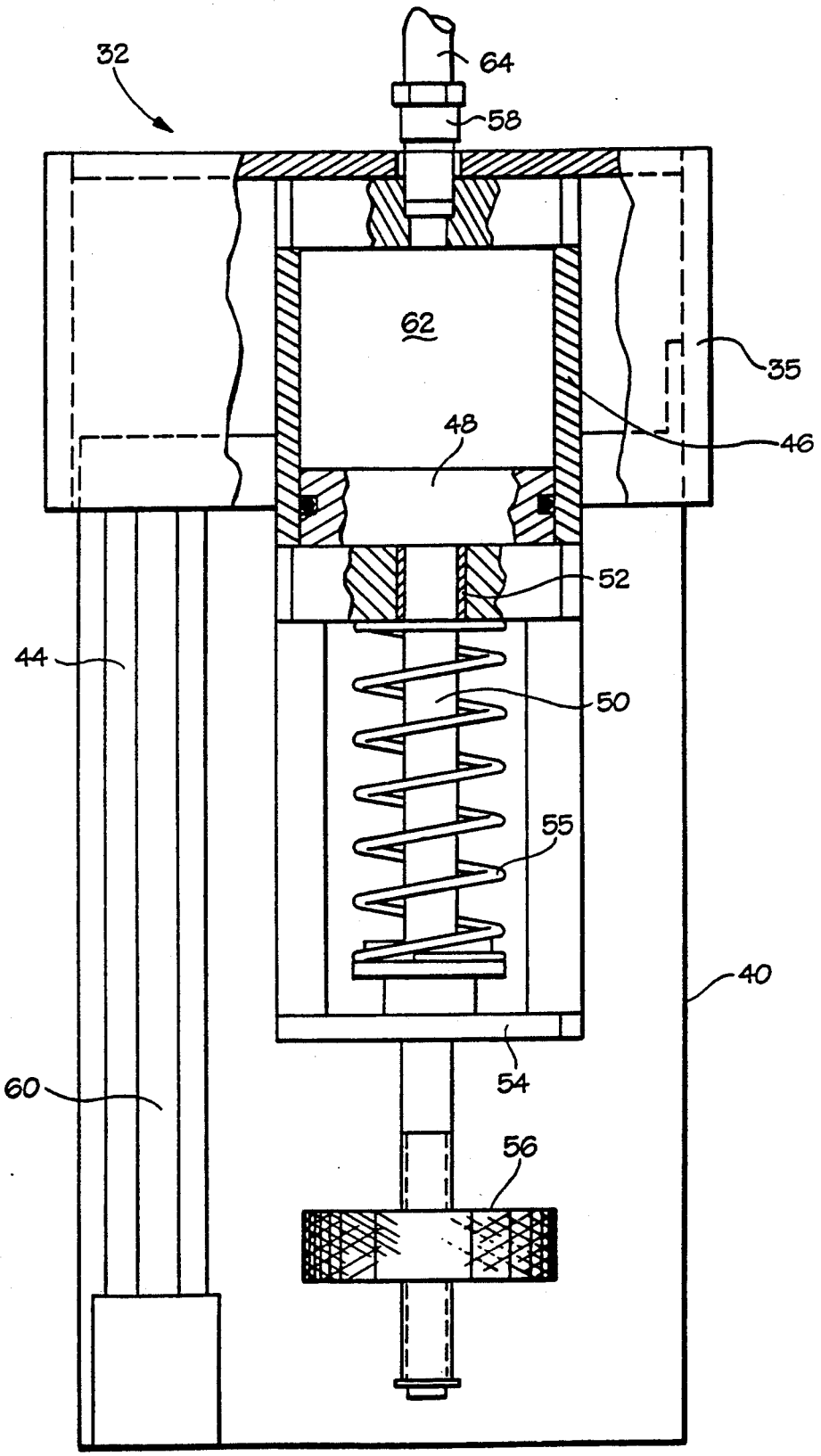
FIG. 5 is an end elevational view of the flushing unit of FIG. 4.
Figure 6:
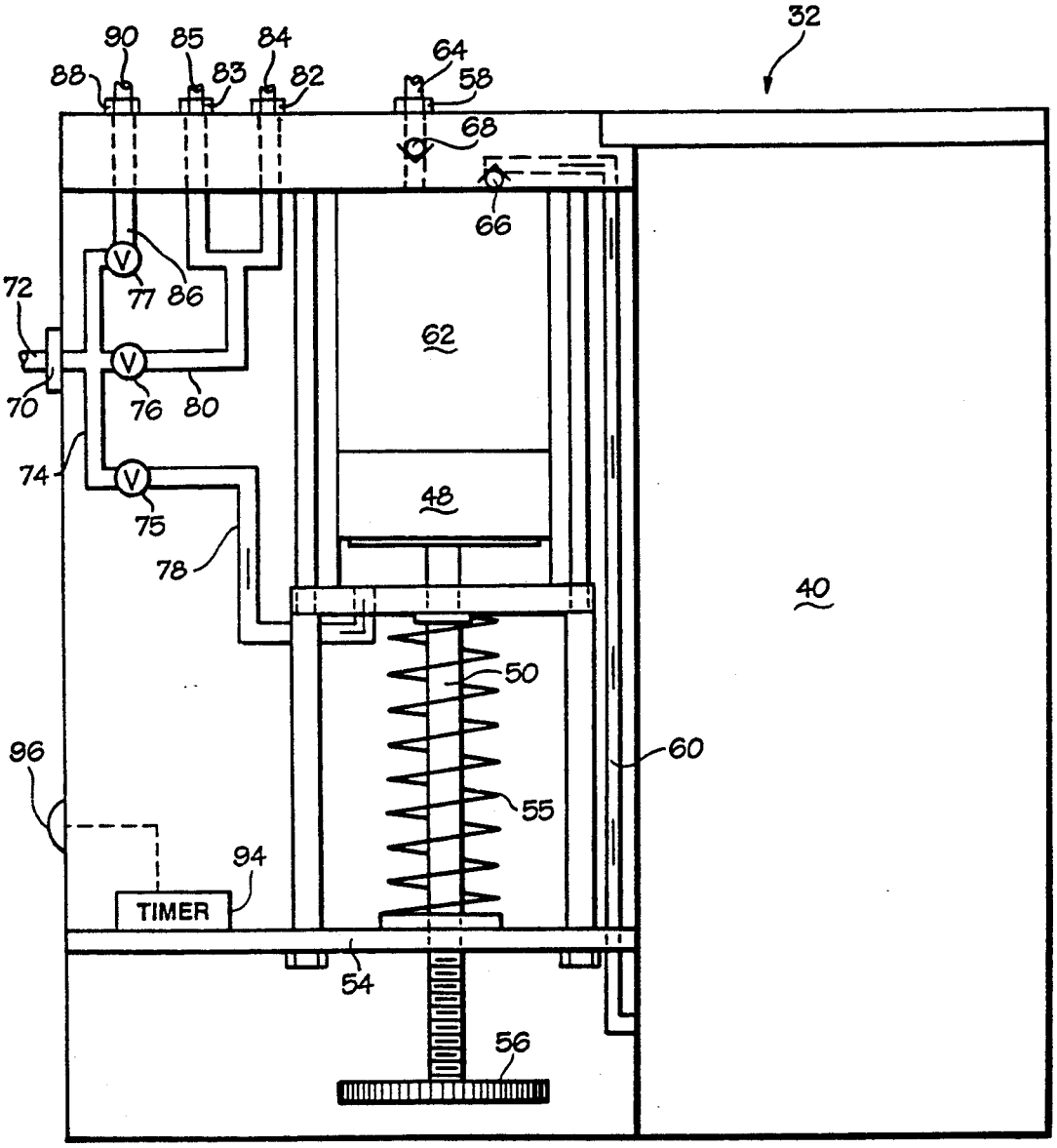
FIG. 6 is a schematic diagram of the flushing unit of FIGS. 4 and 5, showing the fluid and gas flow circuits thereof.

As best seen in FIGS. 4–6, the flushing control unit 32 includes a housing 35 supporting an oil reservoir tank 40 in association with a piston-and-cylinder pumping assembly 42 to provide an oil supply and a means of pressurized delivery of oil to the nozzle 38. A clear or opaque oil fill tube 44 is supported by the housing 35 adjacent the reservoir tank 40 opening at the upper end of the tube 44 through the top wall of the housing 35 and communicating at the lower end of the tube 44 with the reservoir tank 40 to enable the tank to be periodically filled with a supply of oil while at the same time providing a continuous visual indication of the quantity of oil remaining in the tank. In connection with the latter function, the outer surface of the reservoir tank 40 adjacent the fill tube 44 is marked with graduations 45 representing the proportionate quantity of oil at differing levels in the tank 40 relative to the maximum capacity of the tank.

As seen in FIGS. 5 and 6, the piston-and-cylinder pump assembly 42 includes a cylindrical pump housing 46 fixedly mounted to the housing 35 of the flushing control unit 32 and a piston 48 slidably supported within the cylindrical housing 46 for reciprocating axial movement therein. A guide shaft 50 extends downwardly from the underside of the piston 48 slidably through a seal 52 in the lower end wall of the cylindrical pum housing 46 for integral movement with the piston 48. A coil spring 55 is affixed at one end to the guide shaft 50 concentrically thereabout and extends into contact with the pump housing 46 to bias the piston 48 to a normal resting position within the lower end of the pump housing 46. The guide shaft 50 also extends at its lower end slidably through a guide plate 54 affixed rigidly to the pump housing 46 at a spacing therebelow. A stop wheel 56 is threadedly supported on the lower end of the guide shaft 50 beneath the guide plate 54 to abut the guide plate 54 upon upward movement of the piston 48 within the cylinder 46, thereby to adjustably determine the maximum axial operating stroke of the piston 48 within the cylinder 46.

The interior of the cylindrical pump housing 46 above the piston 48 forms a pumping cavity 62, the contents of which are expelled upon an upward operating stroke of the piston 48 against the biasing force of the spring 55 through a flow control fitting 58 supported centrally within the upper end wall of the cylindrical pump housing 46 and projecting upwardly therefrom through the upper end wall of the flushing control unit housing 35. The fitting 58 communicates through a tubular fluid flow conduit 64 with the nozzle 38 to deliver thereto oil expelled from the pump cavity 62 upon each operating stroke of the piston 48. The upper end of the cylindrical pump housing 46 is communicated through a syphon tube 60 with the oil reservoir tank 40 to automatically charge the pump cavity 62 within the cylindrical pump housing 46 with a quantity of oil through a suction force created upon each return stroke of the piston 48 to its normal position at the lower end of the cylinder 46 under the biasing force of the spring 55.

For flow control purposes, the syphon tube 60 is equipped with a check valve 66 (FIG. 6) to prevent reverse fluid flow through the syphon tube 60 during an operating stroke of the piston 48 and, likewise, the fitting 58 is equipped with a check valve 68 (FIG. 6) to prevent reverse fluid flow therethrough upon a return stroke of the piston 48.

The operating stroke of the piston-and-cylinder pumping assembly 42 is actuated by pressurized air delivered to the flushing control unit 32 from a suitable source of pressurized air, such as a centralized pressurized air supply commonly maintained in textile mills. As schematically indicated in FIG. 6, a fitting 70 is provided on the flushing control unit housing 35 for connection to the pressurized air source through a suitable supply conduit 72. Interiorly of the housing 35, a distribution manifold 74 extends from the fitting 70 to a series of three solenoid control valves 75,76,77 arranged in parallel to one another. The valve 75 communicates with a conduit 78 which extends to and opens through the lower end wall of the cylindrical pump housing 46 to selectively control the delivery of pressurized air into the housing 46 for actuating the upward operating stroke of the piston 48.

The valve 76 communicates through a branching conduit 80 with a pair of fittings 82,83 mounted to the upper end wall of the flushing control unit housing 35, which fittings 82,83 in turn respectively communicate through conduits 84,85 with the nozzles 36,37, thereby for selectively delivering pressurized air to each thereof. The valve 77 communicates through another conduit 86 with a third fitting 88 in the upper end wall of the flushing control unit housing 35, which fitting in turn communicates through a conduit 90 with the nozzle 34.

The solenoid valves 75,76,77 are supplied with operating electricity from a conventional electrical source, e.g., through the same electrical circuit supplying operating power to the circular knitting machine. As a result, the valves 75,76,77 may be arranged for manual or automatic operation as desired. Each of the valves 75,76 is normally closed to normally prevent communication between the manifold 74 and the respective conduit 78,80, until the operating solenoid of the valve 75,76 is energized. In contrast, the valve 77 is normally open to normally provide a continuous supply of pressurized air from the manifold 74 through the conduits 86,90 to the nozzle 34. In the embodiment as illustrated, the solenoid to the valve 77 is electrically connected in the electrical supply circuit to the circular knitting machine to maintain the solenoid energized and thereby maintain the valve open throughout ongoing operation of the knitting machine and to de-energize the solenoid to close the valve 77 and terminate air supply to the nozzle 34 whenever the knitting machine is stopped. The valves 75,76 in the illustrated embodiment are arranged for manual operation through a corresponding pair of operating buttons 92,93 mounted at one side of the flushing control unit housing 35 (FIG. 4).

As best seen in FIGS. 1–3, the nozzles 36,38 are arranged closely alongside one another in substantially identical orientation relative to the knitting machine cylinder 14, with their respective nozzle emission openings 36',38' disposed closely adjacent the upper end of the cylinder 14 and directed downwardly at the interface between the cylinder needle slots 16 and the sinker rest ring slots 27 at an angle in the range of 30° to 60° relative to the cylinder axis. As will be understood, it is contemplated that the precise orientation and direction of the nozzles may be varied. For example, in some situations, it will be preferred that the nozzle openings 36',38' be directed toward the radial center of the sinker rest ring 25. To facilitate optimal penetration of the flushing oil into the cylinder slots 16,27, the emission opening 38' of the nozzle 38 is defined by a single circular orifice of a preferred diameter in the range of approximately 0.030 inches for discharging oil through the orifice in the form of a substantially narrow and substantially continuous stream. Likewise, the emission opening 36' in the nozzle 36 is a single circular orifice but of a larger diameter preferably in the range of about 0.125 inches, for similarly discharging a relatively narrow continuous stream of pressurized air.

The nozzle 37 is horizontally mounted beneath the dial 22 with its emission opening 37' directed radially at the needle slots 16 in the cylinder 14 above the location of the needle cam arrangement 20 to discharge its pressurized air stream directly radially into the needle slots 16 of the cylinder 14. The nozzle 37 is substantially identical to the nozzle 36, its emission opening 37' being defined by a circular orifice which is of substantially the same diameter of about 0.125 inches to produce a substantially correspondingly narrow continuous stream of pressurized air. Preferably, the nozzle 37 is disposed directly below the associated nozzle 36 in substantially the same vertical plane to act on the cylinder slots substantially simultaneously.

The nozzle 34 is also disposed in a substantially horizontal orientation but with its emission opening 34' offset to be directed predominantly upwardly at and relatively closely adjacent to the sinker rest ring 25 on the upper end of the cylinder 14 to discharge its pressurized air stream directly against the underside of the sinkers 26 at a location at which they are projected outwardly from their respective dial slots 24 onto the sinker resting surfaces 28 of the sinker rest ring 25 under the control of the sinker cam arrangement 30. The emission opening 34' is defined by a single circular orifice which is slightly larger than that of the nozzle 38 but smaller than that of the nozzles 36,37, preferably in the range of about 0.055 inches to produce a narrow stream of air sufficient to remove any lint and debris from the sinkers 26.

In accordance with the present invention, the piston-and-cylinder pumping assembly 42 should be operable to generate a sufficiently high level of pressure in the flushing oil within the pump cavity 62 to discharge the oil through the fitting 58, the conduit 64, and the nozzle 38 at a sufficiently high velocity to forcibly loosen and expel debris from the cylinder needle and sinker rest ring slots 16,27. When the oil is discharged in a narrow continuous stream as above-described, an oil velocity of about 700 inches per minute or more is contemplated to be sufficient for this purpose but it is preferred that the discharge velocity of the oil be in the range of approximately 1,000 inches per minute. To achieve this level of oil discharge velocity utilizing the described nozzle size, the pressure level in the pressurized air delivered to the flushing control unit 32 should be in the range of at least about 90 pounds per square inch and preferably about 100 pounds per square inch to generate sufficient pressurization of oil within the pumping cavity 62. By way of example, assuming a circular knitting machine of a thirty inch cylinder diameter with twenty-six needle and sinker slots per diametral inch and operating at 800 revolutions per minute, the cylinder slots travel past the fluid nozzle 38 at a rate of approximately 1,000 slots per second and, thus, at a flushing oil velocity of 1,000 inches per second, the oil stream penetrates each cylinder slot approximately one inch.

It is contemplated that a variety of oils and other fluids may be suitable for use as the flushing fluid supplied to the nozzle 38, but it is presently believed that optimal results are achieved by utilizing an oil of a lighter viscosity than normal knitting machine lubricating oil and optionally also including cleaning additives. An oil which has been found to produce satisfactory results is the MADOL 115FO flushing lubricant produced by Boehme Filatex, Inc., of Madison, N.C. Likewise, it is contemplated that a variety of gases could be utilized for supplying the nozzles 34,36,37 but presently pressurized air is most preferred in view of its common availability within textile mills and the minimal expense required for generating pressurized air.

In operation, the cleaning accomplished by the flushing apparatus of the present invention is considered to be sufficiently superior to that achieved by conventional techniques that flushing operation need not be performed upon every doff of a full roll of knitted cloth from the knitting machine but, rather, need only be performed once every several doffs. For example, assuming operation of the knitting machine on a continuous basis for three eight-hour shifts per day for five or six days per week, it is believed that flushing operation of the present flushing apparatus need be performed only once per day (i.e., once every twenty-four hours of machine operation) in order to achieve optimal cleaning of lint and debris from the cylinder slots. Of course, as will be understood, depending upon results achieved on individual knitting machines, it may be desirable to perform flushing operation more often or more seldom, as may be required. To assist the machine operator, the flushing unit 32 may be equipped with a timer, shown only schematically at 94 in FIG. 6, electrically connected in the power supply circuitry for the knitting machine to monitor the actual operating time of the knitting machine and, in turn, actuate a signal, such as an illuminable signal lamp 96, at predetermined intervals of machine operating time to alert the operator when another flushing operation is due. The operator would then actuate the flushing unit 32 upon the next doffing of fabric from the knitting machine thereafter. The timer 94 and signal lamp 96 may be operatively connected with the valve actuating buttons 92,93 so that the signal lamp does not deactuate until the operator has carried out a flushing operation. Alternatively, the timer 94 could be electrically connected in circuit with the solenoid valves 75,76 to actuate automatic periodic operation of the nozzles 36,37,38 as aforementioned.

Each normal flushing cycle of the present flushing apparatus should be ordinarily performed during a doffing of knitted fabric from the machine. Upon each flushing cycle, the machine operator initially actuates the valve operating button 92 to deliver pressurized air into the cylindrical pump housing 46 to advance the piston 48 through the housing and, in turn, expel under pressure the charge of flushing oil contained within the pumping cavity 62. As the knitting machine cylinder 14 rotates, the pressurized oil is discharged in a narrow continuous stream from the orifice 38' of the nozzle 38 directly into the needle and sinker rest ring slots 16,27 at the upper end of the cylinder 14. The pressurization of the oil is sufficient to loosen and at least partially wash accumulated debris from the slots. Actuation in this manner of the valve operating button 92 is continued for a sufficient time to accomplish at least one complete revolution of the knitting machine cylinder 14 or, alternatively, for a longer period of time until the entire contents of the pumping cavity 62 has been discharged. By adjustment of the stop wheel 56 along the guide shaft 50, the capacity of the pumping cavity 62 can be selectively varied to contain a sufficient amount of oil for one complete revolution of the cylinder 14, or if desired a greater quantity of oil. Thereupon, the operator releases the button 92 and actuates the valve operating button 93 to deliver the pressurized air to the nozzles 36,37, which complete the flushing operation by injecting similarly narrow streams of air into the cylinder slots 16,27 as the cylinder 14 continues to rotate, thereby insuring complete penetration of the oil into the slots and also expelling any remaining lint and other debris therefrom. Alternatively, the operator could actuate the valve operating buttons 92,93 simultaneously with comparable cleaning results. As aforementioned, the air nozzle 34 operates continuously over the entire course of operation of the knitting machine and is not affected by actuation of the valve operating buttons 92,93, although it is contemplated to be possible to provide an appropriate arrangement to deactuate the air nozzle 34 upon each flushing operation.

It will therefore be readily understood by those persons skilled in the art that the present invention is susceptible of a broad utility and application. Many embodiments and adaptations of the present invention other than those herein described, as well as many variations, modifications and equivalent arrangements will be apparent from or reasonably suggested by the present invention and the foregoing description thereof, without departing from the substance or scope of the present invention. Aooordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the claims appended hereto and the equivalents thereof.

I claim:

1. In a circular knitting machine of the type having a rotatable cylinder formed with a plurality of slots for receiving reciprocating knitting elements, the improvement comprising apparatus for periodically flushing accumulated debris forcibly from said slots, said flushing apparatus including a source of pressurized flushing fluid, a flushing nozzle fixedly mounted adjacent said cylinder, means for selectively communicating said flushing nozzle with said fluid source to supply said pressurized fluid to said flushing nozzle, said flushing nozzle having an emission opening oriented relative to said cylinder to discharge said pressurized fluid directly into said slots as said cylinder rotates, a source of a pressurized gas, a cleaning nozzle fixedly mounted adjacent said cylinder, means for selectively communicating said cleaning nozzle with said gas source to supply said pressurized gas to said cleaning nozzle, said cleaning nozzle having an emission opening oriented relative to said cylinder to discharge said pressurized gas directly into said slots as said cylinder rotates.

2. The flushing apparatus of claim 1 wherein said flushing nozzle communicating means and said cleaning nozzle communicating means are cooperatively associated for alternate or simultaneous operation.

3. The flushing apparatus of claim 2 wherein each said flushing nozzle communicating means and said cleaning nozzle communicating means comprise a respective valve means.

4. The flushing apparatus of claim 1 wherein said flushing nozzle and said cleaning nozzle are arranged with the respective emission openings disposed alongside one another closely adjacent said cylinder in substantially identical orientation thereto.

5. The flushing apparatus of claim 4 wherein each of said nozzles is oriented with the emission opening directed at a downward angle to said slots.

6. The flushing apparatus of claim 1 wherein each of said nozzles is oriented with the emission opening directed at a downward angle to said slots.

7. The flushing apparatus of claim 1 wherein said flushing nozzle is configured to discharge said pressurized fluid in the form of a relatively narrow and substantially continuous stream.

8. The flushing apparatus of claim 7 wherein said emission opening of said fluid nozzle is defined by a single circular orifice.

9. The flushing apparatus of claim 8 wherein said orifice is of a diameter in the range of approximately 0.030 inches.

10. The flushing apparatus of claim 7 wherein said fluid source generates sufficient pressure in said fluid to discharge said fluid at a sufficient velocity to forcibly remove debris from said slots.

11. The flushing apparatus of claim 10 wherein the velocity of said fluid source is selected in relation to the rotational operating speed of said cylinder to accomplish penetration of said fluid to a predetermined extent in said slots.

12. The flushing apparatus of claim 11 wherein said fluid is discharged from said flushing nozzle at a velocity of at least about 700 inches per minute.

13. The flushing apparatus of claim 12 wherein said discharge velocity of said fluid is approximately 1000 inches per minute.

14. The flushing apparatus of claim 1 wherein said pressurized fluid source includes means for delivery of a predetermined quantity of said pressurized fluid to said flushing nozzle upon each actuation of said flushing nozzle communicating means.

15. The flushing apparatus of claim 14 wherein said pressurized fluid source includes a piston-and-cylinder assembly defining a fluid chamber at one side of said piston opening to said flushing nozzle communicating means, said fluid chamber defining a predetermined fluid volume, a reservoir of said flushing fluid communicating with said chamber for supplying said fluid thereto, and means for actuating movement of said piston to expel said fluid from said chamber upon actuation of said flushing nozzle communicating means.

16. The flushing apparatus of claim 15 and comprised further by means for adjusting the volume of said fluid in said fluid chamber.

17. The flushing apparatus of claim 1 wherein said fluid is at least predominantly an oil and said gas is at least predominantly air.

18. The flushing apparatus of claim wherein said knitting machine includes a rotatable dial fixed with respect to said cylinder for integral rotation therewith and carrying a plurality of sinker elements reciprocable radially relative to said cylinder, and further comprising by another cleaning nozzle fixedly mounted adjacent said dial and means for communicating said another cleaning nozzle with said pressurized gas source, said another cleaning nozzle having an emission opening oriented relative to said dial to discharge said pressurized gas onto said sinker elements as said dial rotates.

19. The flushing apparatus of claim 18 wherein said sinker elements ar operative during reciprocation to project from said dial toward said cylinder, wherein said another cleaning nozzle is oriented with the emission opening directed predominantly axially relative to said cylinder to discharge said pressurized gas onto said sinker elements when said sinker elements are projected from said dial.

20. The flushing apparatus of claim 1 and comprised further by another cleaning nozzle fixedly mounted adjacent said cylinder and communicated with said pressurized gas source through said cleaning nozzle communicating means for discharge of said pressurized gas simultaneously with the first-mentioned cleaning nozzle, said another cleaning nozzle having an emission opening oriented differently relative to said cylinder than the first-mentioned cleaning nozzle.

21. The flushing apparatus of claim 20 wherein said first cleaning nozzle has its said emission opening oriented downwardly relative to said slots and said another cleaning nozzle has said emission opening directed horizontally relative to said slots.

22. The flushing apparatus of claim 1 and comprised further by means for generating a signal periodically during operation of said knitting machine to indicate appropriate intervals for actuation of said flushing apparatus.

23. A method for flusing debris in a circular knitting machine of the type having a rotatable cylinder formed with a plurality of slots for receiving reciprocating knitting elements, comprising periodically cleaning accumulated debris from said slots, said method including the steps of discharging a pressurized flushing fluid and separately discharging a pressurized gas directly into said slots as said cylinder rotates to forcibly flush accumulated debris from said slots.

24. The flushing method according to claim 23 and comprised further by performing said fluid discharging and said gas discharging in alternation.

25. The flushing method according to claim 23 and comprised further by performing said fluid discharging and said gas discharging simultaneously.

26. The flushing method according to claim 23 and comprised further by performing said discharging steps periodically.

27. The flushing method according to claim 26 and comprised further by performing said discharging steps about once every twenty-four hours of operation of said knitting machine.

28. The flushing method according to claim 26 and comprised further by performing said discharging steps after a predetermined number of doffs of said knitting machine.

29. The flushing method according to claim 23 and comprised further by discharging said fluid at a downward angle to said slots.

30. The flushing method according to claim 23 and comprised further by discharging said fluid in the form of a relatively narrow and substantially continuous stream.

31. The flushing method according to claim 30 and comprised further by discharging said fluid at a sufficient velocity to forcibly remove debris from said slots.

32. The flushing method according to claim 31 and comprised further by discharging said fluid at a sufficient velocity in relation to the rotational operating speed of said cylinder to penetrate said fluid to a predetermined extent in said slots.

33. The flushing method according to claim 32 and comprised further by discharging said fluid at a velocity of at least about 700 inches per minute.

34. The flushing method according to claim 33 and comprised further by discharging said fluid at a velocity of at least about 1,000 inches per minute.

35. The flushing method according to claim 23 and comprised further by discharging a predetermined quantity of said fluid.

36. The flushing method according to claim 23 wherein said fluid is at least predominantly an oil and said gas is at least predominantly air.

37. The flushing method according to claim 23 wherein said knitting machine includes a rotatable dial fixed with respect to said cylinder for integral rotation therewith and carrying a plurality of sinker elements reciprocable radially relative to said cylinder, and further comprising discharging said pressurized gas onto said sinker elements as said dial rotates.

38. The flushing method according to claim 37 wherein said sinker elements are operative during reciprocation to project from said dial toward said cylinder, and further by comprising discharging said pressurized gas onto said sinker elements when said sinker elements are projected from said dial.

39. The flushing method according to claim 23 and comprised further by simultaneously discharging said pressurized gas in differing directions into said slots.

40. The flushing method according to claim 39 and comprised further by simultaneously discharging one stream of said pressurized gas downwardly into said slots and another stream of said pressurized gas horizontally into said slots.

41. The flushing method according to claim 23 and comprised further by generating a signal periodically during operation of said knitting machine to indicate appropriate intervals for actuation of said flushing apparatus.

* * * * *

UNITED STATES PATENT AND TRADEMARK OFFICE

CERTIFICATE OF CORRECTION

PATENT NO. : 5,195,337

DATED : March 23, 1993

INVENTOR(S) : Alan Gutschmit

It is certified that error appears in the above-identified patent and that said Letters Patent is hereby corrected as shown below:

Column 4, line 28, delete "ad]acent" and insert therefor -- adjacent --.

Column 4, line 58, delete "knittinq" and insert therefor -- knitting --.

Column 5, line 13, after "to" insert -- be --.

Column 5, line 22, delete "knittinq" and insert therefor -- knitting --.

Column 6, line 8, delete "pum" and insert therefor -- pump --.

Column 10, line 12, delete "Aooordingly" and insert therefor -- Accordingly --.

Column 11, line 43, after "claim" insert -- 1 --.

Column 11, line 48, delete "by".

Column 11, line 55, delete "ar" and insert therefor -- are --.

Column 12, line 13, delete "flusing" and insert therefor -- flushing --.

UNITED STATES PATENT AND TRADEMARK OFFICE

CERTIFICATE OF CORRECTION

PATENT NO. : 5,195,337

DATED : March 23, 1993

INVENTOR(S) : Alan Gutschmit

It is certified that error appears in the above-indentified patent and that said Letters Patent is hereby corrected as shown below:

Column 13, line 8, delete "by"

Signed and Sealed this

Eighteenth Day of January, 1994

*Attest:*

Bruce Lehman

BRUCE LEHMAN

*Attesting Officer*

*Commissioner of Patents and Trademarks*